US006942368B1

(12) United States Patent
Kane et al.

(10) Patent No.: US 6,942,368 B1
(45) Date of Patent: Sep. 13, 2005

(54) ACCESSORY CARTRIDGE FOR LIGHTING FIXTURE

(75) Inventors: Kenneth M. Kane, Trumbull, CT (US); Vincent D. Gennarelli, Washingtonville, NY (US)

(73) Assignee: Lighting Services Inc., Stony Point, NY (US)

( * ) Notice: Subject to any disclaimer, the term of this patent is extended or adjusted under 35 U.S.C. 154(b) by 2 days.

(21) Appl. No.: 10/688,172

(22) Filed: Oct. 17, 2003

(51) Int. Cl.[7] ..... F21S 13/02; F21S 13/12

(52) U.S. Cl. ..... 362/457; 362/150; 362/319; 362/396; 362/404; 362/433

(58) Field of Search ..... 362/396, 457, 362/433, 439, 404, 145, 147, 150, 319

(56) References Cited

U.S. PATENT DOCUMENTS

| | | | | | |
|---|---|---|---|---|---|
| 1,363,537 | A | | 12/1920 | Scott | |
| 1,616,306 | A | * | 2/1927 | Dake | 362/375 |
| 2,465,248 | A | * | 3/1949 | McCandless | 362/304 |
| 2,477,705 | A | * | 8/1949 | Sweet | 292/17 |
| 2,587,423 | A | * | 2/1952 | Young | 362/301 |
| 2,785,291 | A | * | 3/1957 | Bernstein | 362/255 |
| 2,953,970 | A | * | 9/1960 | Maynard | 359/611 |
| 4,310,875 | A | * | 1/1982 | Price | 362/277 |
| 4,321,659 | A | * | 3/1982 | Wheeler | 362/293 |
| 4,593,344 | A | * | 6/1986 | Basile | 362/226 |
| 4,709,311 | A | * | 11/1987 | Bornhorst | 362/277 |
| 4,745,533 | A | * | 5/1988 | Smerz | 362/364 |
| 5,971,573 | A | * | 10/1999 | Bucher et al. | 362/438 |
| 6,079,992 | A | * | 6/2000 | Kuchar et al. | 439/122 |
| 6,203,173 | B1 | * | 3/2001 | Duff et al. | 362/268 |
| 6,441,976 | B1 | | 8/2002 | Okorocha | |
| 6,632,007 | B2 | * | 10/2003 | Agro | 362/455 |

* cited by examiner

*Primary Examiner*—Stephen Husar
*Assistant Examiner*—Jason Han
(74) *Attorney, Agent, or Firm*—Schweitzer Cornman Gross & Bondell LLP

(57) ABSTRACT

An accessory cartridge for removable reception in a specialized lighting fixture. A circular cartridge ring is provided with an internal lower flange, for supporting one or more flat, circular, disc-like accessory elements, such as filters. Retainer clips are positioned to engage at least the uppermost one of the disc-like accessory elements, such that one or more of the disc-like accessory elements may be easily installed within the cartridge ring and the entire series thereof automatically retained therein by engagement of at least the uppermost accessory element. The entire cartridge is designed to be bodily installed in or removed from the lighting fixture, to facilitate expeditious changing of accessory elements utilized with the lighting fixture. Preferentially, the lighting fixture is provided with a hingedly connected front barrel portion, which is constructed to receive and support the cartridge. The cartridge can be easily removed and/or installed when the barrel portion is hinged to an open position.

12 Claims, 3 Drawing Sheets

ACCESSORY CARTRIDGE FOR LIGHTING FIXTURE

BACKGROUND OF THE INVENTION

Specialized lighting fixtures for such applications as theatrical lighting, museums, galleries, exhibits, etc. frequently involve the use of directed beam spotlight fixtures, typically mounted on a track, which can easily be adjusted as to location and as to direction of the beam for achieving desired results. In many cases, such specialized lighting fixtures employ accessory elements, such as color filters, conditioners, beam spreading lenses, etc.

In environments in which the lighting requirements change from time to time, for example, in theaters, museums, etc., it may be necessary to replace or exchange some or all of the accessory elements installed in a particular fixture. The present invention is directed to mechanisms for significantly expediting and simplifying the installation, removal and/or exchange of accessory elements in specialized lighting fixtures of the type described. Additionally, since the foregoing operations frequently have to be attended to by a workman standing on a ladder, there are safety issues involved in connection with the installation, removal and/or exchange of accessory elements, which can be dealt with beneficially by simplifying and expediting the tasks involved.

SUMMARY OF THE INVENTION

The present invention is directed to a specialized lighting fixture useful in theatrical lighting and other specialized applications, both commercial and residential, involving the use of accessory elements which are expected to be changed from time to time for achieving various lighting effects. Pursuant to the invention, a special accessory cartridge is provided, which is removably installed within the lighting fixture, in the outlet portion thereof, and incorporates facilities for expeditiously securing one or a plurality of disc-like accessory elements, for achieving desired lighting effects. The basic arrangement is such that the accessory cartridge can be loaded with one or more accessory elements, as desired for the effects to be achieved, and the pre-loaded accessory cartridge simply inserted into the lighting fixture. The installation and/or removal of the accessory cartridge is quickly and easily accomplished in a manner that minimizes the hazard to a workman on a ladder, where such is required in order to reach the lighting fixture.

In accordance with one aspect of the invention, an advantageous form of accessory cartridge is provided which comprises a generally circular cartridge ring of an appropriate size and shape to receive one or a plurality of flat, disc-like accessory elements. In a typical case, from one to three accessory elements may be installed in the accessory cartridge before the cartridge is installed in the lighting fixture. The cartridge ring accordingly is provided with simple resilient means to accommodate the snap-in installation of accessory elements, one at a time, one above the other, with the entire "stack" of disc-like accessory elements being resiliently held in a fixed position relative to the accessory cartridge.

To particular advantage, and in accordance with one of the specific aspects of the invention, a unique and advantageous form of retainer clip is provided on the inner side wall of the cartridge ring for engagement with peripheral edges of the individual accessory elements. The retainer clip is uniquely shaped and contoured such that, with one or more such clips secured at one or more positions on the side wall of the cartridge ring, each accessory element is engaged and resiliently retained as it is installed in the cartridge ring, with at least the uppermost accessory element of a series thereof being engaged and resiliently retained and thus serving to retain any previously installed accessory element.

Preferably, the cartridge ring has an inwardly extending flange at the bottom, for supporting the accessory elements, and an outwardly extending flange at the top, for engagement with support areas of the lighting fixture.

In a most advantageous embodiment of the invention, the described accessory cartridge is incorporated in a lighting fixture having a tubular front barrel portion which can be separated or partially separated from the main body of the fixture for reception of the accessory cartridge. The front barrel portion is provided with an upwardly facing annular shoulder for seating the upper flange of the cartridge ring. Preferentially, the front barrel portion is hinged to the main body of the lighting fixture, such that the front barrel portion may be opened to receive the accessory cartridge while remaining attached to the body of the fixture.

For a more complete understanding of the above and other features and advantages of the invention, reference should be made to the following detailed description of a preferred embodiment thereof and to the accompanying drawings.

DESCRIPTION OF PREFERRED EMBODIMENT

Figure 1:
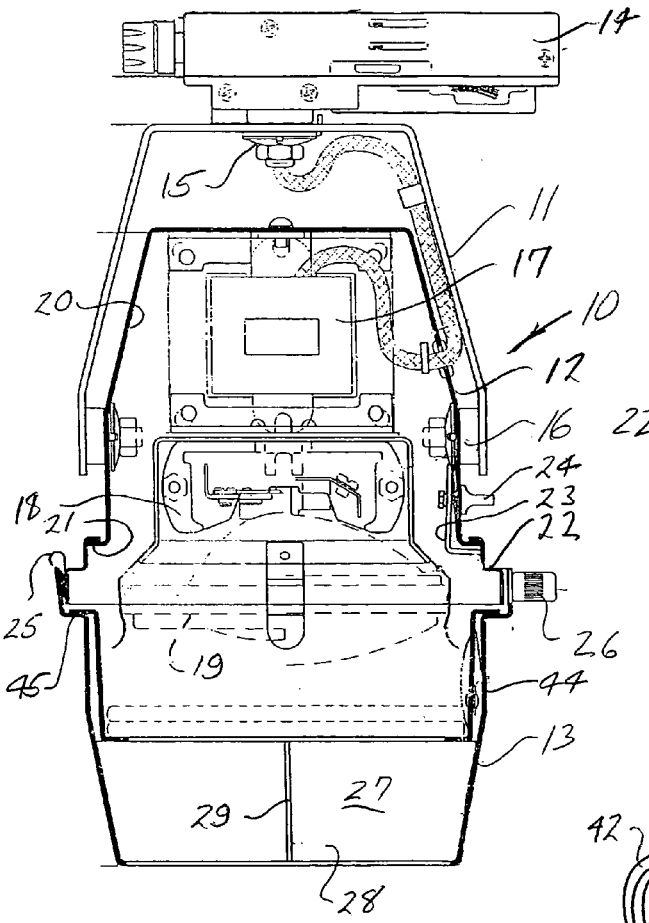
FIG. 1 is a longitudinal cross sectional view of a specialized lighting fixture adapted to incorporate the accessory cartridge of the invention.

Referring now to the drawings, the reference numeral 10 designates generally a specialized lighting fixture including a mounting bracket 11, a main body 12 and front barrel portion 13. The mounting bracket 11 typically is secured to an elongated track (not shown) by way of a housing 14, which can be secured to the track in any position along its length, all pursuant to well known concepts. The mounting bracket 11 is pivotally mounted at 15 for rotation about a vertical axis, and the body 12 of the fixture is pivotally mounted at 16 for rotation about a horizontal axis.

In the illustrated fixture, the body 12 may house a transformer 17 (for low voltage lighting) and mounts a suitable socket 18 for receiving an illuminating bulb 19.

The outer housing 20 of the main body 12 is provided at its lower end with an outwardly extending annular flange 21 which supports an annular rotation ring 22. The ring 22 is freely rotatable relative to the body housing 20, but can be locked in a preset position by means of a locking element 23 and locking screw 24.

Figure 2:
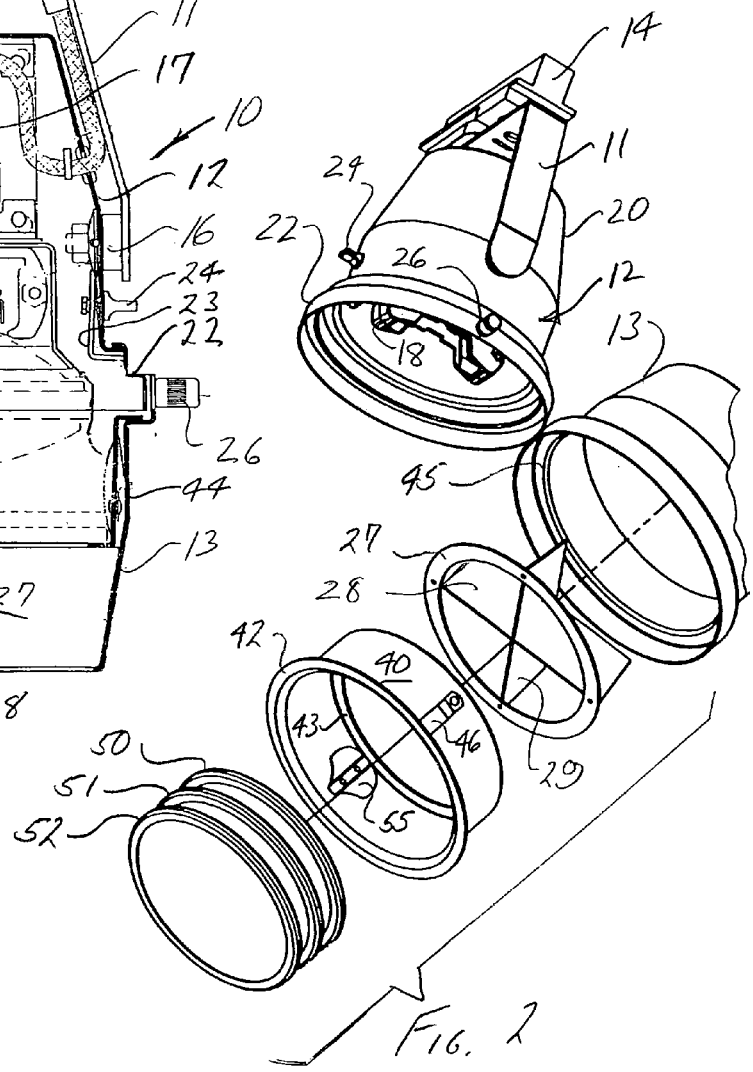
FIG. 2 is an exploded view illustrating the manner of assembly of various components into the opened front barrel portion of the lighting fixture.
Figure 4:
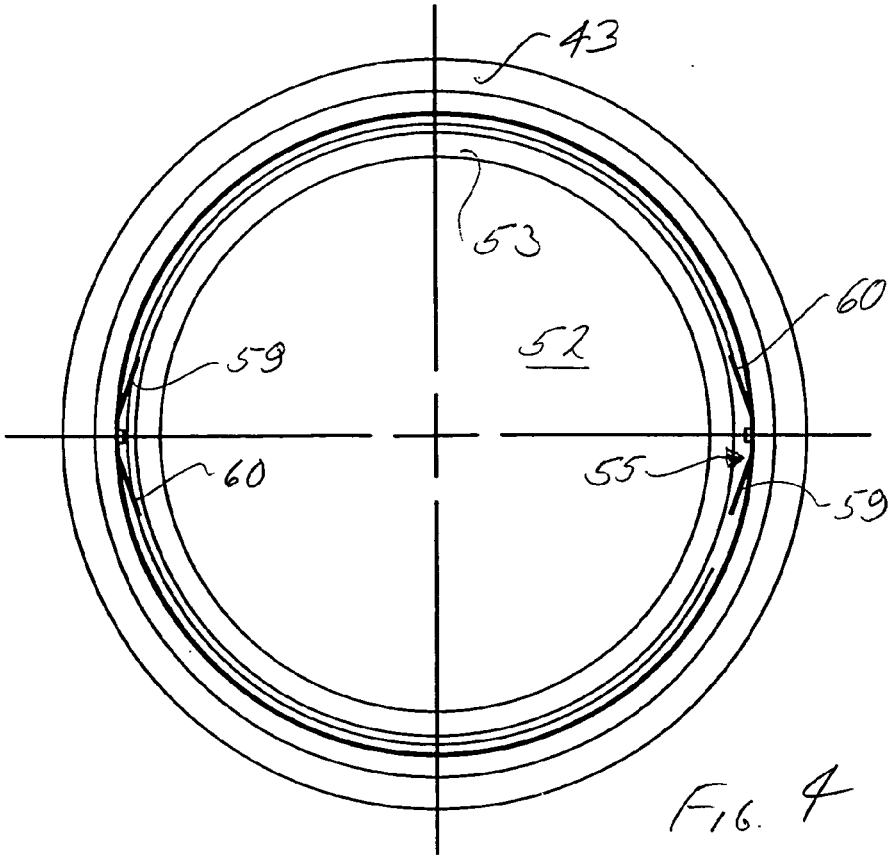
FIG. 4 is a top plan view of the accessory cartridge with one or more accessory elements received therein.

In the illustrated light fixture, the front barrel 13 is secured to the rotation collar 22 by a hinge 25, which allows the front barrel portion to be swung away from the body housing 20, generally in the manner indicated in FIG. 2 to, among other things, provide access for replacement of bulbs, accessory elements, etc. A locking screw 26 secures the front barrel in its "closed" position, and also provides a convenient engagement means for rotating the front barrel when it is released by loosening of the locking screw 24. A cross baffle 27 is removably received in the front portion of the barrel 13. The cross baffle consists of a pair of baffle plates 28, 29 arranged at 90 degrees and with their respective planes intersecting the principal longitudinal axis of the light beam.

The lighting fixture as thus far described is commercially available from Lighting Services Inc., Stony Point, N.Y., under their designation 238 Series Spotlights. For lights of this general type, it is conventional to employ various accessory elements, such as color filters, spreading lenses for controlling the shape of the spot, conditioners, screens, etc. The present invention is directed particularly to a novel accessory cartridge device that is easily installed in and removed from the lighting fixture, and which accommodates the installation therein of one or a plurality of disc-like accessory elements. The arrangement of the invention significantly simplifies and expedites the installation and replacement of such accessory elements.

In a preferred embodiment of the invention, the accessory cartridge comprises a cartridge ring 40 which includes a generally cylindrical side wall 41, an outwardly extending annular flange 42 at the upper end thereof and an inwardly extending annular flange 43 at the lower end thereof. The diameter of the cylindrical wall 41 is slightly less than the diameter of the upper wall portion 44 of the front barrel of the lighting fixture. The upper flange 42 of the accessory cartridge is arranged to be supported on a shoulder 45 formed in an upper portion of the front barrel 13. To advantage, opposed retaining springs 46 are fixed to the outside of the cylindrical wall 41 of the cartridge ring, and these springs are adapted to bear resiliently outward against the side wall 44 of the front barrel portion 13 such that, when the cartridge ring 40 is inserted into the front barrel portion 13, it is temporarily held therein against accidental dislodgement by the friction of the springs 46.

Pursuant to the invention, the inner diameter of the cartridge ring wall 41 is slightly greater than the outer diameter of a standard size disc-like accessory element, such as represented at 50–52 in the drawings. The typical accessory element may be comprised of a circular peripheral ring 53, formed of metal and having a U-shaped cross sectional configuration, and a circular plate 54 formed of glass, plastic or the like and having the characteristics desired, such as color, UV filtration, focusing, conditioning, etc. In the illustrated form of the device, the cartridge ring 40 is designed to receive one to three accessory elements. However, pursuant to the principles of the invention, the cartridge ring may be designed to receive a greater number of accessory elements, should there be a need for such.

Figure 3:
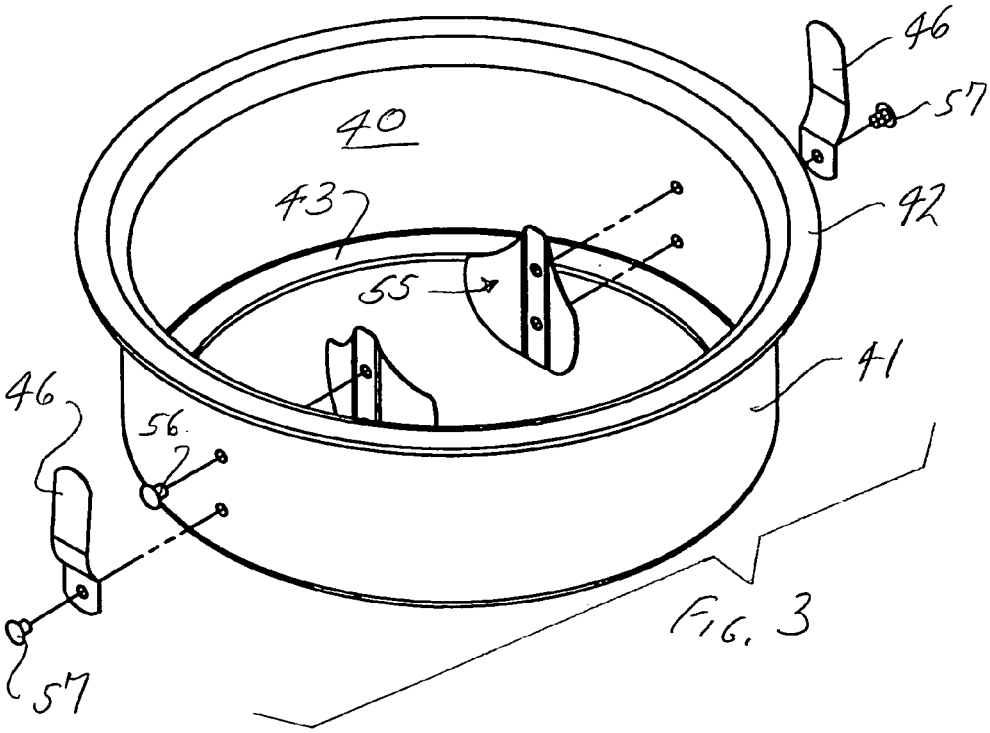
FIG. 3 is an exploded perspective view of an accessory cartridge incorporating the features of the invention.
Figure 5:
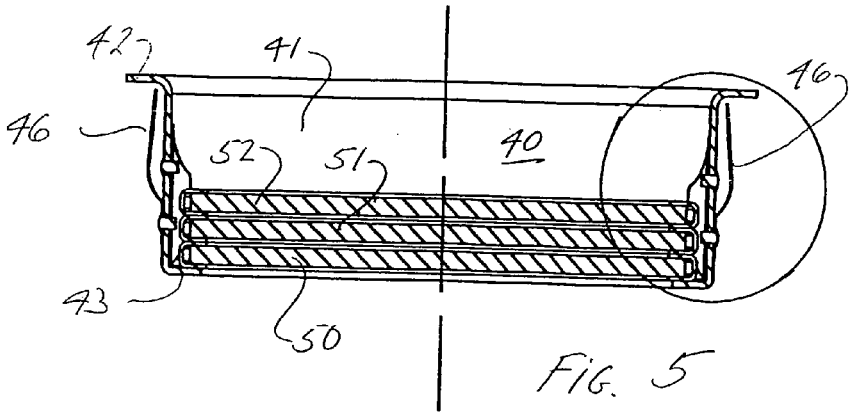
FIG. 5 is a longitudinal cross sectional view as taken generally on line 5—5 of FIG. 4.
Figure 7:
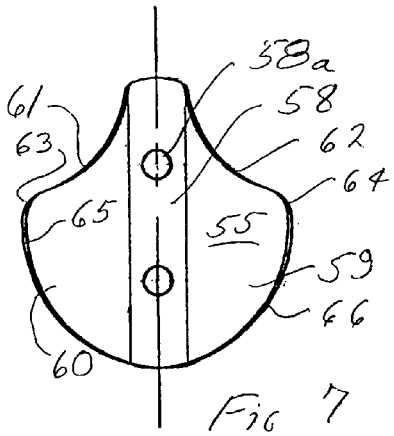
FIG. 7 is a front elevational view of a retainer clip element forming part of the accessory cartridge of the invention.
Figure 8:
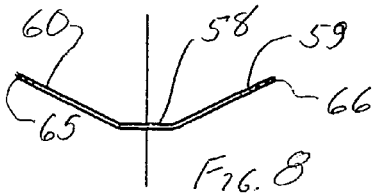
FIG. 8 is a top plan view of the retainer clip of FIG. 7.

In accordance with the invention, the disc-like accessory elements 50–52 are releasably retained within the cartridge rings by means of specially contoured retainer clips 55, shown individually in FIGS. 7 and 8, which are secured to the inside surface of the wall 41 of the cartridge ring. Preferably, and as reflected in FIG. 3, the retainer clips 55 are secured to the wall 41 by a pair of rivets 56, 57, one of which (57 in this instance) is also utilized for mounting the retaining springs 46.

The retainer clips 55 advantageously are formed of a flat, spring steel material of, for example, 0.015 in thickness, and are formed with a generally flat central panel portion 58 provided with openings 58*a* for the rivets 56, 57, and provided on opposite sides with spring panels 59, 60 which extend at an angle to the plane of the central portion 58. In the illustrated form of the device, in which the diameter of the cartridge ring 40 may be on the order of five inches, the side panels 59, 60 suitably are disposed at an angle of about 25 degrees relative to the plane of the central panel portion 58.

As reflected in FIG. 7, the retainer clips advantageously can be formed of a generally circular metal piece, say of around 1.25 inches in diameter, preferably with upper portions thereof removed to form concave upper contours at 61, 62, and formed with generously rounded corners 63, 64 at a level slightly above one-half the height of the element 55. For example, approximately 0.75 inch above the bottom in a part having an overall height of about 1.25 inches. Preferentially, the retainer clips are mounted with their lower edges contacting or closely adjacent the bottom flange 43 of the cartridge ring 41.

Pursuant to the invention, the contoured edges of the retainer clips 55 function to automatically assure that the last accessory element 50–52 installed in the cartridge ring will be securely gripped by outer edge portions 65, 66 of the opposed retainer clips. Thus, when inserting a single accessory cartridge 50, the accessory element is placed in the upper portion of the cartridge ring until it rests upon the upper corner areas 63, 64 of the retainer clips. The accessory element can then be pressed downward, deflecting the side panels 59, 60 of the retainer clips, until the accessory element rests upon the lower flange 43 of the cartridge ring.

Figure 6:
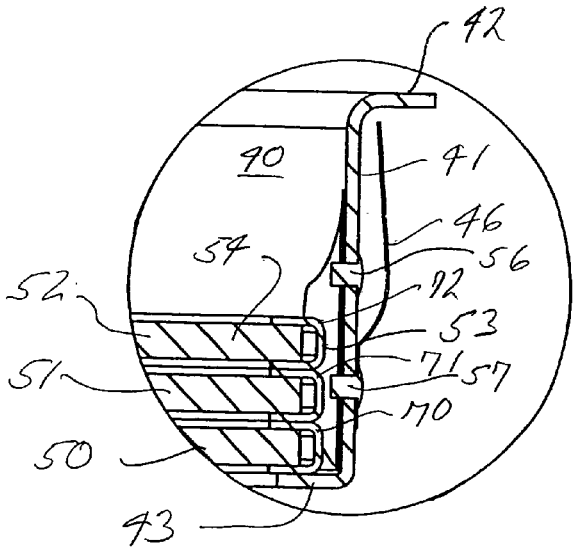
FIG. 6 is an enlarged, fragmentary view of an encircled portion of FIG. 5, showing details thereof.

As will be understood, the edges 65, 66 of the retainer clips will be spaced a greater distance radially inward from the cylindrical wall 41 at the widest portions of the retainer clips and will be spaced progressively lesser distances from the wall 41 opposite the lower portions of the retainer clip. The normal clearance space between the side edge extremities of the accessory elements and the inner surface of the side wall 41 is such that, when the accessory element 50 is in its lowest position, seated on the flange 43 of the cartridge ring, lower portions of the retainer clip edges 65, 66 will bear against upper corner portions 70 (FIG. 6) of the accessory element to retain it snugly in the accessory cartridge.

If a second accessory element 51 is to be inserted into the cartridge, it is inserted in the same manner as the first element 51, deflecting the side panels 59, 60 of the retainer clip as the accessory element is pressed downwardly and seated directly atop the first-loaded accessory element 50. In that position, upper corner portions 71 of the peripheral ring surrounding the accessory element 51 are engaged by portions of the panel edges 65, 66 higher up along the retainer clips 55. Inasmuch as the edge portions of the retainer clips engaged with the second accessory element 51 tend to be spaced farther inward from the wall 41 than edge portions below, the panels 59, 60 will be resiliently displaced radially outward somewhat by the second accessory element 51 when it is finally seated against the lower element 50. This may relieve the resilient pressure of the retainer clips against the lower accessory element 50, either partly or entirely. However, since the second level accessory 51 is now firmly gripped by the retainer clips, the "stack" of the two accessory elements is firmly held in place in the accessory cartridge.

Similarly, if a third accessory element 52 is to be installed, it is pressed into the accessory cartridge until it seats directly on top of the second element 51, and upper corner portions 72 of the third accessory element 52 are then contacted by upper portions of the panel edges 65, 66. To the extent that retaining pressure against the lower accessory elements is partially or entirely relieved by displacement of the panels 59, 60 by the uppermost accessory element 52, the entire stack remains firmly installed in the cartridge by the gripping action on the uppermost accessory element 52, as will be understood.

Pursuant to the invention, the accessory cartridge can be conveniently loaded with one or more desired accessory elements while removed from and remote from the lighting fixture. After the cartridge has been properly loaded, the front barrel portion 13 of the lighting fixture can be pivoted to an open position (if closed) and a cartridge ring 40 inserted into the upper portion of the front barrel until the upper flange 42 of the cartridge ring is seated on the shoulder 45 of the front barrel portion. The accessory cartridge will tend to be self-retaining within the front barrel during the installation process, by reason of the friction of the springs 46 mounted on the opposite exterior walls of the cartridge ring, acting against the barrel wall 44. After the cartridge ring is installed in position, the front barrel portion 13 is closed and locked.

Reloading of the cartridge ring, as may be desired from time to time for different lighting effects, is easily accomplished by simply opening the front portion of the lighting fixture, bodily removing the accessory cartridge, and reloading it with the desired new accessories. The cartridge is then quickly and efficiently reinstalled in the lighting fixture as previously indicated.

With the device of the invention, not only is the re-accessorizing operation greatly simplified and expedited, but it is also made a great deal safer for the servicing personnel, in cases where access to the lighting fixture requires the workman to stand on a ladder. Additionally, when necessary to access the lighting fixture for re-lamping, the front barrel portion can be simply opened up to provide access to the bulb 19, without affecting any accessory discs previously installed and without having to be concerned with their accidental dislodgement from the lighting fixture.

It should be understood of course that the specific embodiment of the invention herein illustrated and described is intended to be representative only, as certain variations may be made therein without departing from the clear teachings of the disclosure. In addition, specific directional references such as up, down, bottom, top, etc. are not limiting and are referenced only to the orientation of the illustrated views. Accordingly, reference should be made to the following appended claims in determining the full scope of the invention.

What is claimed is:

1. An accessory cartridge for removable and interchangeable reception in a specialized lighting fixture, which comprises (a) a cartridge ring having a generally circular side wall portion and generally open bottom and top portions, (b) one or a plurality of generally flat, disc-like accessory elements adapted for loose-fitting reception within the side wall portions of said cartridge ring, (c) said side wall portions having an axial dimension sufficient to accommodate the simultaneous reception of a plurality of accessory elements within said cartridge ring, (d) support flange portions adjacent said bottom portion and extending radially inward to form a bottom limit stop for an accessory element received within said cartridge ring, (e) at least one retainer clip element positioned on said side wall portion for engagement with outer edge portions of an upper one of said one or a plurality of accessory elements positioned in axially stacked relation within said cartridge ring, (f) said retainer clip element comprising a resilient element extending inward from said side wall portions at an angle thereto such that portions of said resilient element closer to the bottom portion of said cartridge ring extend inward a distance less than portions of said resilient element farther removed from said bottom portion, (g) said resilient element engaging and resiliently bearing inwardly against at least the upper one of said one or a plurality of disc-like accessory elements for restraining a single such accessory element or an axially aligned stack of a plurality of such accessory elements against upward movement relative to said cartridge ring, (h) said retainer clip element comprising a contoured spring element, separate from side wall portions of said cartridge ring, formed of sheet metal and having a generally flat central portion disposed generally parallel to a central axis of said cartridge ring and fixed to the inside of a side wall portion thereof, (i) said retainer clip element further comprising a pair of wing-like side elements extending laterally from opposite sides of said central portion and disposed at a shallow angle extending away from adjacent side wall portions of said cartridge ring, (j) said wing-like side elements being contoured such that lateral edges of portions thereof located axially more remote from the bottom of said cartridge ring are spaced farther inward from the side wall portions of said cartridge ring than are portions of said side elements located closer to said bottom.

2. An accessory cartridge according to claim 1, wherein (a) said wing-like elements are in the form of generally flat panels disposed at a shallow angle to said central portion, (b) said wing-like side elements being contoured to extend laterally farther from said central portion in first portions thereof located axially more remote from the bottom of said cartridge ring than in second portions thereof located closer to said bottom, whereby said first portions are spaced farther inward from the side wall portions of said cartridge ring than are said second portions of said side elements.

3. An accessory cartridge according to claim 1, wherein (a) a plurality of retainer clips as described are mounted on said side wall portions, at circumferentially spaced locations thereon, for engagement with said one or a plurality of accessory elements at a plurality of circumferentially spaced apart positions.

4. The combination of accessory cartridge according to claim 1 with a lighting fixture, wherein (a) the lighting fixture is formed with a main body portion and a front barrel portion, (b) said front barrel portion is of tubular construction and is hingedly joined at an upper end thereof with a lower end of said main body portion, and (c) said cartridge ring is removably received within an upper portion of said front barrel portion.

5. The combination of claim 4, wherein (a) an upper portion of said front barrel portion is formed with an upwardly facing annular shoulder, and (b) said cartridge ring is provided, in an upper portion thereof, with an outwardly extending flange arranged to be supported on said annular shoulder.

6. The combination of claim 5, wherein (a) resilient means are provided on at least one of (i) an outer surface of the cartridge ring side wall portion or (ii) an inner surface of said front barrel portion, for releasably positioning said cartridge ring within said front barrel portion.

7. An accessory cartridge for removable and interchangeable reception in a tubular front portion of a specialized lighting fixture, which comprises (a) a cartridge ring having a generally circular side wall portion and generally open bottom and top portions, (b) an inwardly projecting flange at a lower portion of said cartridge ring, (c) one or a plurality of generally flat, disc-like accessory elements adapted for loose-fitting reception within the side wall portions of said cartridge ring, (d) a lowermost one of said accessory elements being supported on said inwardly projecting flange, (e) said side wall portions having an axial dimension sufficient to accommodate the simultaneous reception of said lowermost accessory element and one or more additional accessory elements within said cartridge ring to form an axially adjacent stack of accessory elements, and (f) at least one resilient retainer element secured to an inside wall of said cartridge ring and positioned for resilient engagement with edge portions of at least an uppermost one of said one or a plurality of accessory elements positioned within said cartridge ring for restraining a single such accessory element or an axially aligned stack of a plurality of such accessory elements against upward movement relative to the bottom of said cartridge ring, (g) said resilient retainer element comprising a resilient element extending inward from said side wall portions at an angle thereto, such that portions of said resilient element closer to the bottom portion of said cartridge ring extend inward from said side wall a distance less than portions of said resilient element farther removed from said bottom portion, (h) said resilient element engaging and resiliently bearing inwardly against at least the upper one of said one or a plurality of disc-like accessory elements for restraining said one or a plurality of accessory elements against upward movement relative to the bottom of said cartridge ring, (i) said resilient retainer element comprising a contoured spring element, separate from side wall portions of said cartridge ring, formed of sheet metal and having a generally flat central portion disposed generally parallel to a central axis of said cartridge ring and fixed to the inside of a side wall portion thereof, (j) said resilient retainer element further comprising a pair of wing-like side elements extending laterally from opposite sides of said central portion and disposed at a shallow angle extending away from adjacent side wall portions of said cartridge ring, (k) said wing-like side elements being contoured such that portions thereof located axially more remote from the bottom of said cartridge ring are spaced farther inward from the side wall portions of said cartridge ring than are portions of said side elements located closer to said bottom.

8. An accessory cartridge according to claim 7, wherein (a) said wing-like elements are in the form of generally flat panels disposed at a shallow angle to said central portion, (b) said wing-like side elements being contoured to extend laterally farther from said central portion in first portions thereof located axially more remote from the bottom of said cartridge ring than in second portions thereof, whereby said first portions are spaced farther inward from the side wall portions of said cartridge ring than are said second portions of said side elements.

9. The combination of claim 7, wherein (a) said cartridge ring is formed with an outwardly extending annular flange adjacent the top portion thereof for supporting said cartridge within a lighting fixture.

10. The combination of accessory cartridge according to claim 7 with a lighting fixture, wherein (a) the lighting fixture is formed with a main body portion and a tubular front barrel portion, (b) said front barrel portion is hingedly joined at an upper end thereof with a lower end of said main body portion, and (c) said cartridge ring is removably received in an upper portion of said front barrel portion.

11. The combination of claim 10, wherein (a) an upper portion of said front barrel portion is formed with an upwardly facing annular shoulder, and (b) said cartridge ring is provided, in an upper portion thereof, with an outwardly extending flange arranged to be supported on said annular shoulder.

12. The combination of claim 11, wherein (a) resilient means are provided for releasably retaining said cartridge ring within said front barrel portion.

* * * * *